US007735756B2

(12) United States Patent
Schindler et al.

(10) Patent No.: US 7,735,756 B2
(45) Date of Patent: Jun. 15, 2010

(54) ADVANCED MECHANICAL ATOMIZATION FOR OIL BURNERS

(75) Inventors: Edmund S. Schindler, Fairfield, CT (US); Scott Lindemann, Oxford, CT (US); John Dale, Stratford, CT (US)

(73) Assignee: Combustion Components Associates, Inc., Monroe, CT (US)

( * ) Notice: Subject to any disclaimer, the term of this patent is extended or adjusted under 35 U.S.C. 154(b) by 351 days.

(21) Appl. No.: 11/734,351

(22) Filed: Apr. 12, 2007

(65) Prior Publication Data

US 2007/0241210 A1 Oct. 18, 2007

Related U.S. Application Data

(60) Provisional application No. 60/791,605, filed on Apr. 12, 2006.

(51) Int. Cl.
*B05B 1/34* (2006.01)

(52) U.S. Cl. ..... 239/490; 239/493; 239/596; 239/404

(58) Field of Classification Search ..... 239/404, 239/490, 491, 492, 533.12, 596; 431/187
See application file for complete search history.

(56) References Cited

U.S. PATENT DOCUMENTS

| | | | | | |
|---|---|---|---|---|---|
| 957,014 | A | * | 5/1910 | Thornycroft | 239/73 |
| 1,261,282 | A | | 4/1918 | Peabody | |
| 2,428,748 | A | * | 10/1947 | Barz | 239/472 |
| 3,861,852 | A | | 1/1975 | Berger | 431/1 |
| 4,087,050 | A | * | 5/1978 | Tsuji et al. | 239/490 |
| 4,695,225 | A | * | 9/1987 | Hellat et al. | 415/189 |
| 4,819,878 | A | | 4/1989 | Bailey et al. | 239/427 |
| 4,890,793 | A | | 1/1990 | Füglistaller et al. | 239/427 |
| 4,893,752 | A | | 1/1990 | Spink et al. | 239/427.3 |
| 5,025,989 | A | | 6/1991 | Spink et al. | 239/431 |
| 5,143,297 | A | | 9/1992 | De Michele et al. | 239/427 |
| 5,269,495 | A | | 12/1993 | Döbbeling | 239/590.3 |
| 5,622,489 | A | | 4/1997 | Monro | 431/187 |
| 5,826,798 | A | | 10/1998 | Schindler et al. | 239/403 |
| 5,860,600 | A | | 1/1999 | Schindler et al. | 239/463 |
| 5,931,387 | A | | 8/1999 | Hurley et al. | 239/492 |
| 5,957,392 | A | | 9/1999 | Pincus | 239/548 |
| 6,024,301 | A | | 2/2000 | Hurley et al. | 239/492 |
| 6,053,431 | A | | 4/2000 | Hurley et al. | 239/492 |
| 6,279,603 | B1 | | 8/2001 | Czarnik et al. | 137/339 |
| 6,311,902 | B1 | | 11/2001 | Mueller | 239/548 |
| 6,405,945 | B1 | | 6/2002 | Dobrin | 239/463 |
| 6,425,755 | B1 | | 7/2002 | Pillard et al. | 431/159 |
| 6,478,239 | B2 | | 11/2002 | Chung et al. | 239/398 |
| 6,622,944 | B1 | | 9/2003 | Hurley et al. | 239/426 |
| 6,691,928 | B2 | | 2/2004 | Chung et al. | 239/8 |
| 6,814,307 | B2 | | 11/2004 | Hurley et al. | 239/492 |
| 6,824,085 | B2 | | 11/2004 | Sebastian et al. | 239/585.1 |

(Continued)

*Primary Examiner*—Dinh Q Nguyen
(74) *Attorney, Agent, or Firm*—St. Onge Steward Johnston & Reens LLC

(57) ABSTRACT

An atomizer spray plate including a body having an inlet surface and an exit surface, a swirl chamber within the body and adjacent to the inlet surface, an atomizer hole extending through the body from the swirl chamber to the exit surface, and a plurality of elongated protrusions upon the inlet surface extending radially from the swirl chamber, wherein the plurality of elongated protrusions define a plurality of venturi inlets to the swirl chamber between adjacent protrusions.

20 Claims, 6 Drawing Sheets

U.S. PATENT DOCUMENTS 6,892,962 B2 5/2005 Hurley et al. ..... 239/406
6,899,290 B2 * 5/2005 Varble et al. ..... 239/533.12
6,951,454 B2 10/2005 Sarv et al. ..... 431/9

* cited by examiner (A-A)

(B-B)

ADVANCED MECHANICAL ATOMIZATION FOR OIL BURNERS

CROSS-REFERENCE TO RELATED APPLICATIONS

This application claims priority benefits under 35 §U.S.C. 119(e) of the U.S. Provisional Application No. 60/791,605, filed on Apr. 12, 2006.

FIELD OF THE INVENTION

The invention relates to atomizers, and more specifically to an advanced mechanical atomizer for providing fine oil droplets for ignition in an oil burner.

BACKGROUND OF THE INVENTION

Atomizers are used in any number of applications to dispense or discharge fluids. For example, atomizers may be used for discharging fuel oil in an oil burner or boiler. Many different types of atomizers exist, one such type being a swirl atomizer. In swirl atomizers, liquid is generally directed into an atomizing nozzle or device having a swirl chamber. The liquid rotates in the swirl chamber and forms a thin conical sheet. The sheet is then directed via a hole or slot and breaks into ligaments and discrete particles or droplets upon exiting the nozzle. The droplets then mix with combustion air and evaporate and burn in a flame.

It is desired in oil burner applications to achieve an oil mist exiting the nozzle having fine fluid droplets. Decreasing the oil droplet size generally will reduce the unburned fuel carbon particles that contribute to the black opacity emission from the boiler or combustion device. One method for decreasing an atomizer's fluid droplet size is to provide increased liquid pressure to the atomizer. In swirl atomizers, the increased liquid pressure increases the angular velocity of the liquid within the swirl chamber and may result in a thinner film and hence a finer spray. However, typically substantial pressure must be provided to achieve an optimal droplet size. Achieving such high pressure adds significantly to the cost of atomization.

U.S. Pat. No. 5,269,495 to Döbbeling illustrates a high pressure atomizer having a liquid feed annulus, a plurality of straight radial supply ducts, and a turbulence chamber with an exit orifice. The liquid enters the turbulence chamber through the radial supply ducts where it impinges upon liquid entering from an opposing turbulence duct. This impingement creates a shearing action to atomize the liquid. While Döbbeling suggests that the atomizer achieves small droplet sizes, an inlet fluid pressure of approximately 2175 psig is required to do so.

U.S. Pat. No. 6,024,301 to Hurley et al. teaches an atomizer spray plate for discharging fuel oil. The atomizer taught by Hurley includes a cylindrical rear portion having a number of whirl slots to provide fuel oil with rotational energy to a whirl chamber. The atomizer taught by Hurley does not require the substantial inlet pressure of other prior art devices and thus provides a less costly means for atomization. However, the Hurley atomizer does not achieve the fluid droplet sizes provided by the high pressure atomizers.

It is therefore desired to provide an atomizer that provides fine fluid droplet sizes without the necessity for substantial inlet pressure.

SUMMARY OF THE INVENTION

Accordingly, it is an object of the present invention to provide a mechanical atomizer having an efficient means to discharge fluid particles with small droplet sizes.

It is a further object to provide a mechanical atomizer with means to reduce pressure at its inlet and use the lowered pressure to effect atomization.

These and other objectives are achieved by providing an atomizer spray plate including a body having an inlet surface and an exit surface, a swirl chamber within the body and adjacent to the inlet surface, an atomizer hole extending through the body from the swirl chamber to the exit surface, and a plurality of elongated protrusions upon the inlet surface extending radially from the swirl chamber, wherein the plurality of elongated protrusions define a plurality of venturi inlets to the swirl chamber between adjacent protrusions. In some embodiments, the spray plate is adapted to receive a liquid fuel via the inlet surface and discharge a fuel mist via the exit surface.

Further provided is an atomizer spray plate including a body having an inlet surface and an exit surface, a swirl chamber within the body and adjacent to the inlet surface, an atomizer hole extending through the body from the swirl chamber to the exit surface, and a plurality of venturi inlets upon the inlet surface extending radially from the swirl chamber, wherein the plurality of venturi inlets are adapted to receive fluid at a first velocity and provide the fluid to the swirl chamber at a second increased velocity. In some embodiments, the exit surface includes two or more discharge slots for directing a spray pattern of exiting fluid.

Also provided is an atomizer assembly for an oil fired burner including a spray plate comprising a body having an inlet surface and an exit surface, a swirl chamber adjacent to the inlet surface, an atomizer hole extending through the body from the swirl chamber to the exit surface, wherein the inlet surface includes a plurality of elongated protrusions extending radially from the swirl chamber, and wherein the plurality of elongated protrusions define a plurality of venturi inlets to the swirl chamber between adjacent protrusions, a back plate mountable adjacent to the inlet surface, and a housing comprising the spray plate and the back plate, wherein the atomizer is adapted to receive liquid fuel and discharge a fuel mist via the exit surface.

Other objects of the invention and its particular features and advantages will become more apparent from consideration of the following drawings and accompanying detailed description.

DETAILED DESCRIPTION OF THE INVENTION

Figure 1:
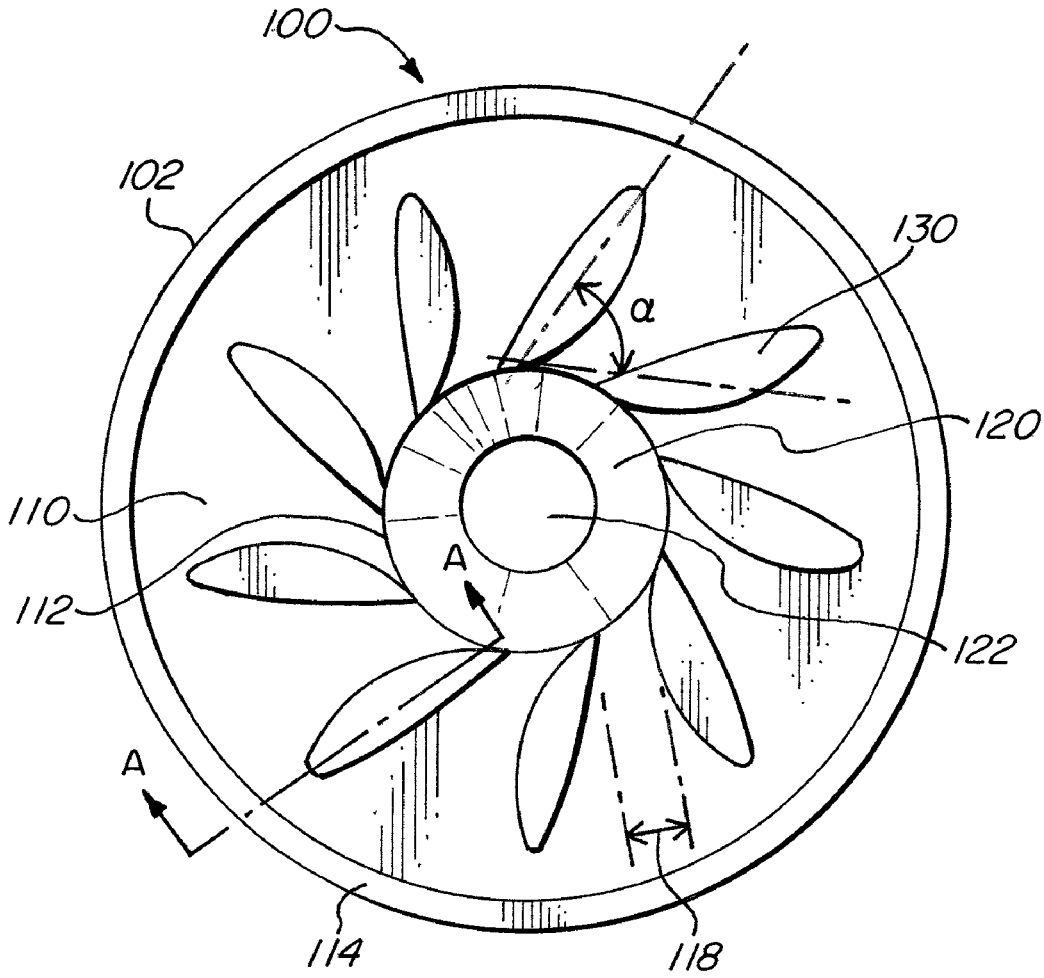
FIG. 1 is a rear view of an atomizer spray plate according to an exemplary embodiment of the present invention.

FIG. 1 shows a rear view of an atomizer spray plate 100 according to an exemplary embodiment of the present invention. The spray plate 100 includes a body 102. The body 102 may have any shape or size. For example, the shape and size may be selected to accommodate a particular application of the spray plate 100. In the present embodiment the body has a substantially cylindrical shape.

Figure 2A:
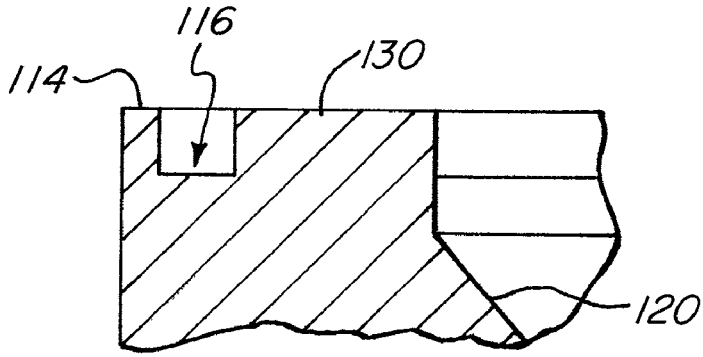
FIG. 2A is a cross-sectional view (A-A) of the atomizer spray plate shown in FIG. 1.
Figure 2B:
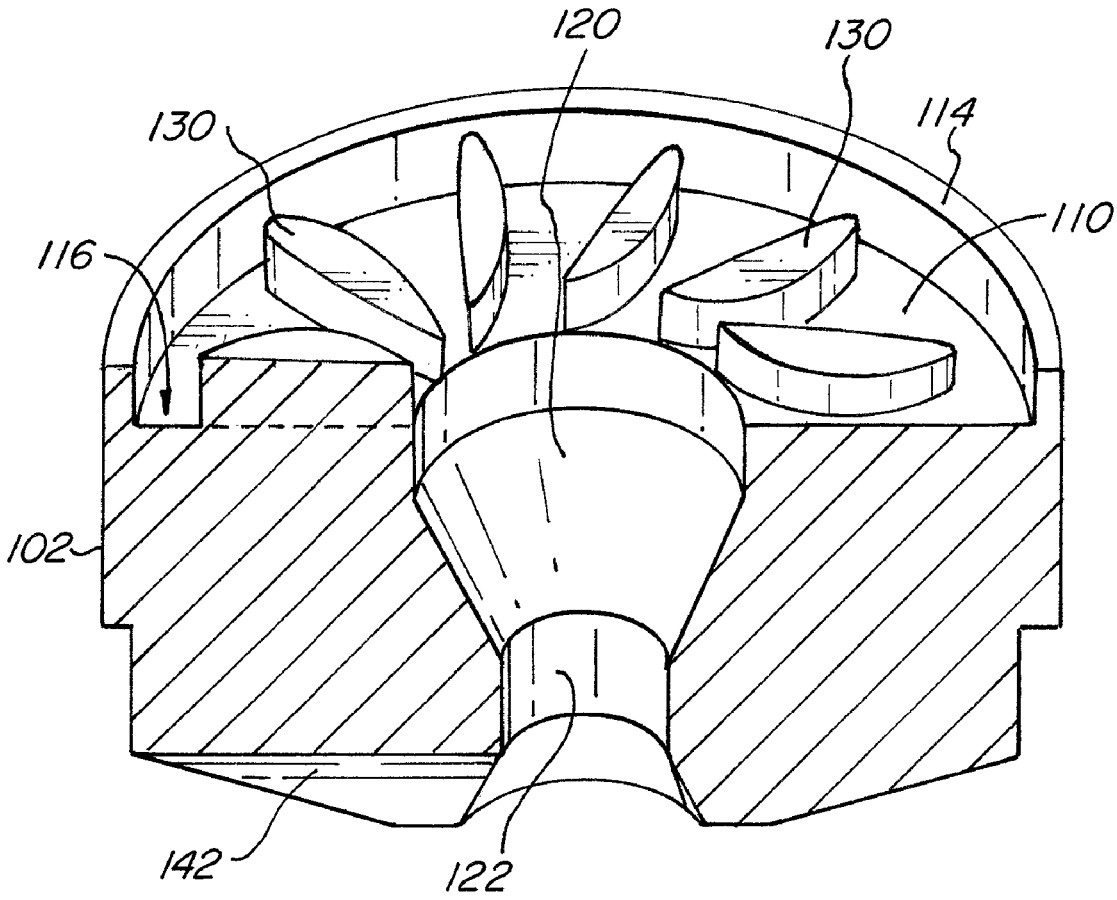
FIG. 2B is another cross-sectional view of the atomizer spray plate shown in FIG. 1.

The spray plate 100 further includes an inlet portion having an inlet surface 110. In some embodiments, the depth of the inlet portion is shorter than inlets generally found in conventional mechanical atomizers. The inlet surface 110 includes a plurality of elongated protrusions or fluid deflectors 130 (e.g., islands). Better illustrated in FIGS. 2A and 2B, each protrusion 130 extends outward from the inlet surface 110. The protrusions 130 extend radially from an inner edge 112 and towards an outer edge 114 about the inlet surface 110. The protrusions 130 are preferably also situated at an angle ($\alpha$) with respect to the inner edge 112, e.g., to assist in initiating rotation and/or generating a swirling motion. The angle $\alpha$ is the exemplary embodiment is less than ninety degrees (e.g., with respect to a tangent at or around the base of the protrusion 130).

The spray plate 100 further includes a swirl chamber 120, which is preferably frustoconical or hemispherical in shape. The swirl chamber 120 is adjacent to the inner edge 112 of the inlet surface 110, and receives fluid from the inlet portion and/or inlet surface 110 wherein the fluid rotates and forms a thin conical sheet of fluid.

Each of the protrusions 130 on the inlet surface 110 has a particular shape defining a venturi passage or swirl slot 118 between adjacent protrusions 130 and leading to the swirl chamber 120. As one of ordinary skill in the art will understand, the shape of the protrusions 130 provides for a reduced pressure at the inlet and an increased velocity in accordance with Bernoulli's principle and the Venturi effect. Fluid is accelerated through each of the swirl slots 118 and about the protrusions 130 into the swirl chamber 120. In the exemplary embodiment, velocity of the fluid entering the swirl chamber 120 is approximately 65% greater than velocities achieved in conventional mechanical atomizers. Rotational velocity in the swirl chamber 120 is thus substantially increased and a thinner sheet of fluid is formed therein. As one of ordinary skill in the art will understand, the thinner sheet then provides for the formation of smaller fluid droplets.

Figure 3A:
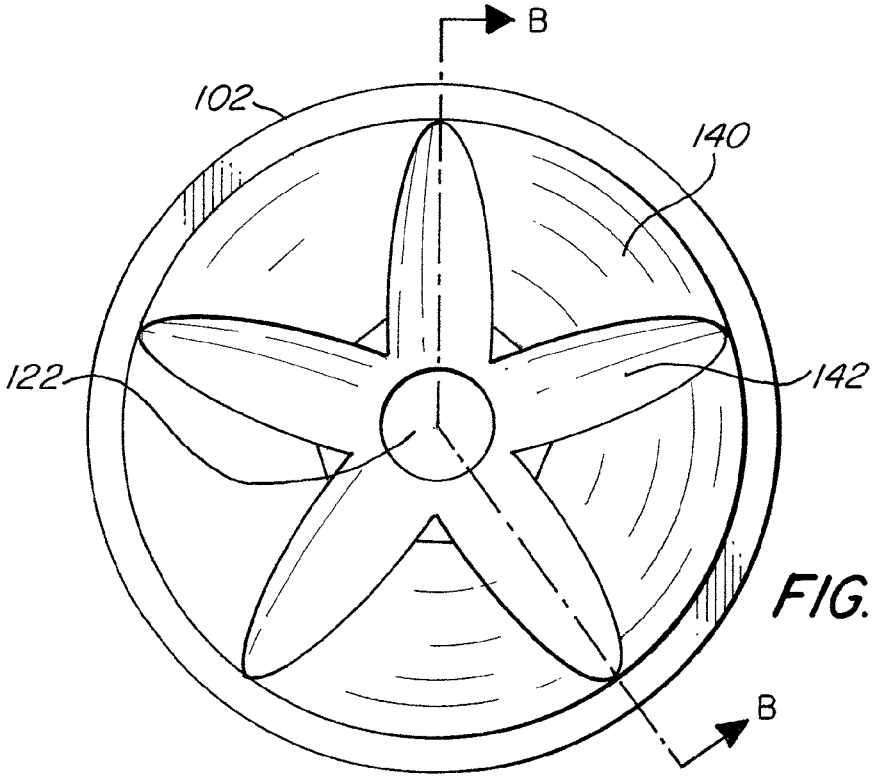
FIG. 3A is a front view of the atomizer spray plate shown in FIG. 1.
Figure 3B:
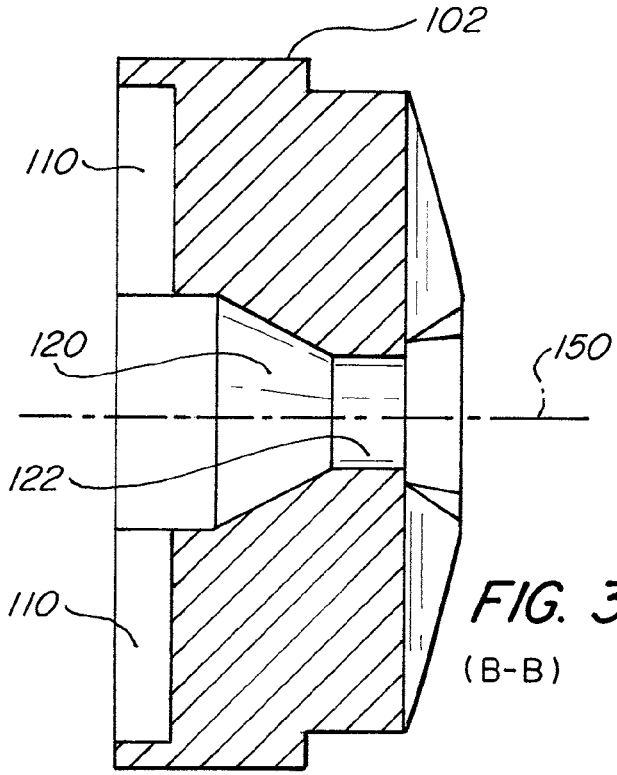
FIG. 3B is a cross-sectional view (B-B) of the atomizer spray plate shown in FIGS. 1 and 3A.

FIG. 3A shows an exit or exit surface 140 of the atomizer spray plate 100 and FIG. 3B shows a cross-sectional view (B-B) of the exemplary spray plate 100. The atomizer spray plate 100 includes atomizer hole 122 extending through the body from the swirl chamber 120 to the exit 140. In the exemplary embodiment, the hole 122 is a cylindrical hole having an axis 150. The exit surface 140 may simply include an outlet edge of the atomizer hole 122 (not shown). However, in some embodiments, the exit surface 140 further includes a shaped surface having two or more discharge slots 142, e.g., for directing the fluid from the atomizer spray plate 100 and/or providing a particular spray pattern. For example, the exit surface 140 may include five discharge slots 142 extending radially from the atomizer hole 122. In some embodiments, the spray pattern provided by the discharge slots 142 advantageously reduces the formation of nitrogen oxide ("$NO_x$").

Figure 4:
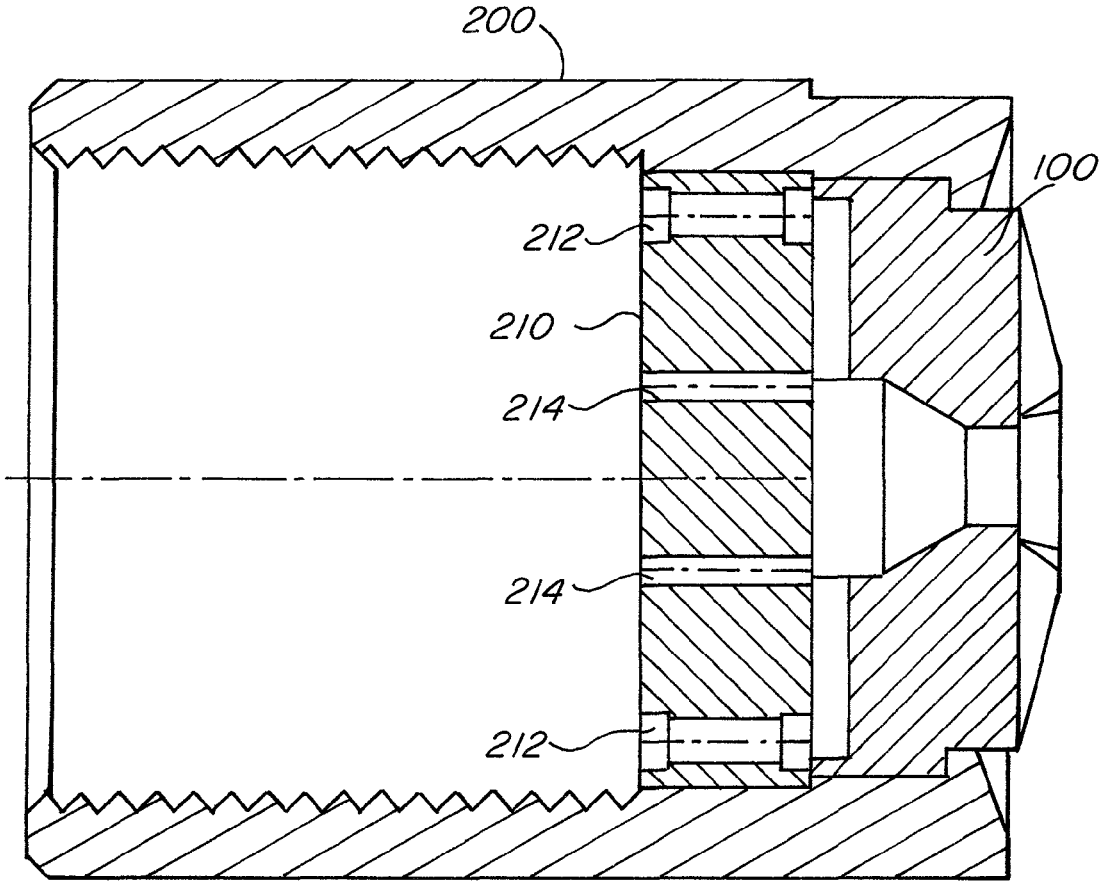
FIG. 4 is a cross-sectional view of an exemplary atomizer assembly including the atomizer spray plate shown in FIG. 1.

FIG. 4 shows an atomizer 200 according to the present invention. The atomizer 200 includes a spray plate 100 such as the exemplary embodiment described above. The atomizer 200 further includes a back plate 210 situated adjacent to the inlet surface 110 of the spray plate 100. The back plate 210 includes one or more channels 212 for providing fluid, such as fuel oil, to the inlet surface 110 of the spray plate 100. In some embodiments, the back plate 210 further includes one or more return channels 214 for receiving fluid from the spray plate 100. Each of the spray plate and back plate 210 are housed in a retaining nut 200.

Figure 5:
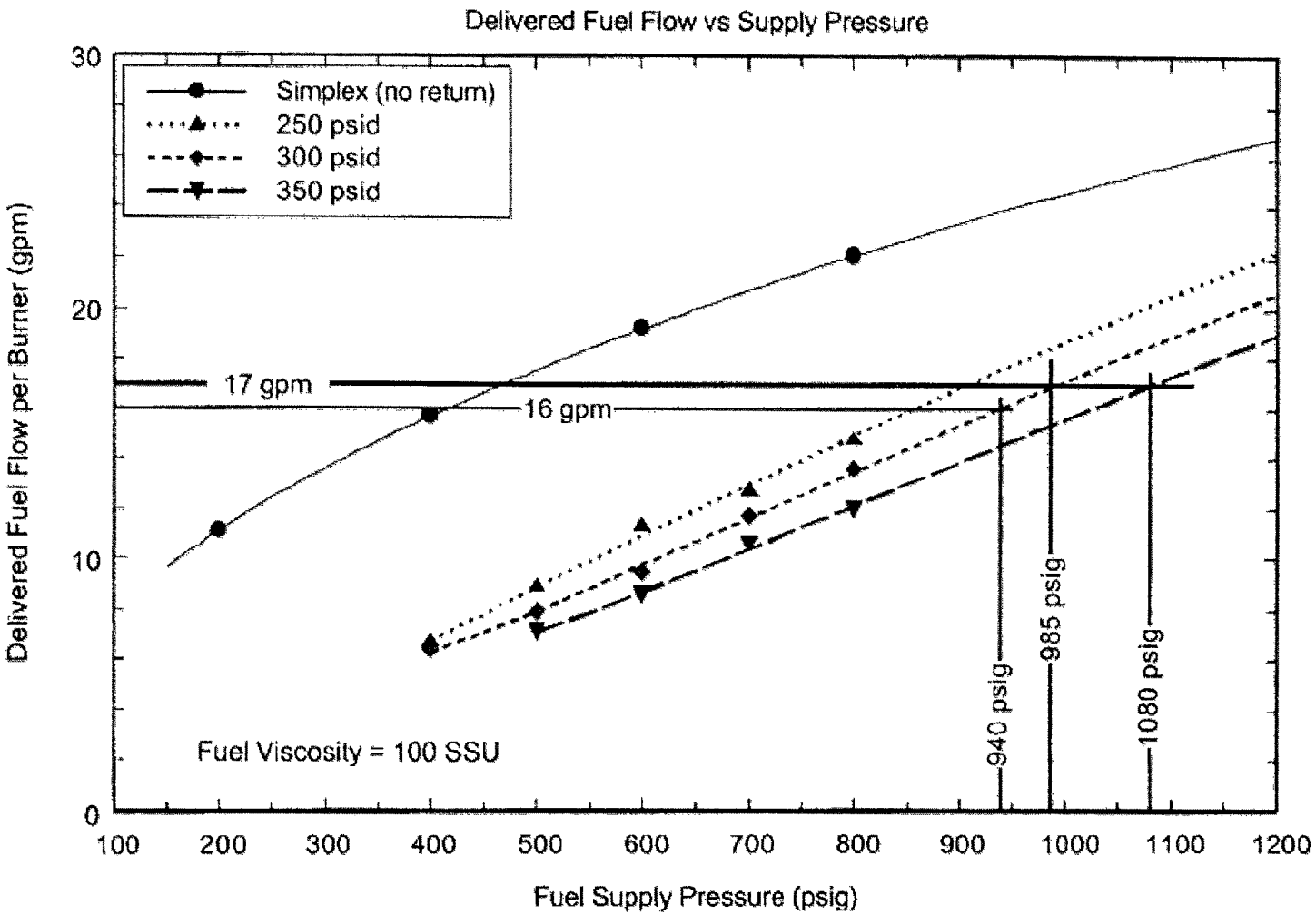
FIG. 5 is graph illustrating performance of an atomizer spray plate according to an exemplary embodiment of the present invention.
Figure 6:
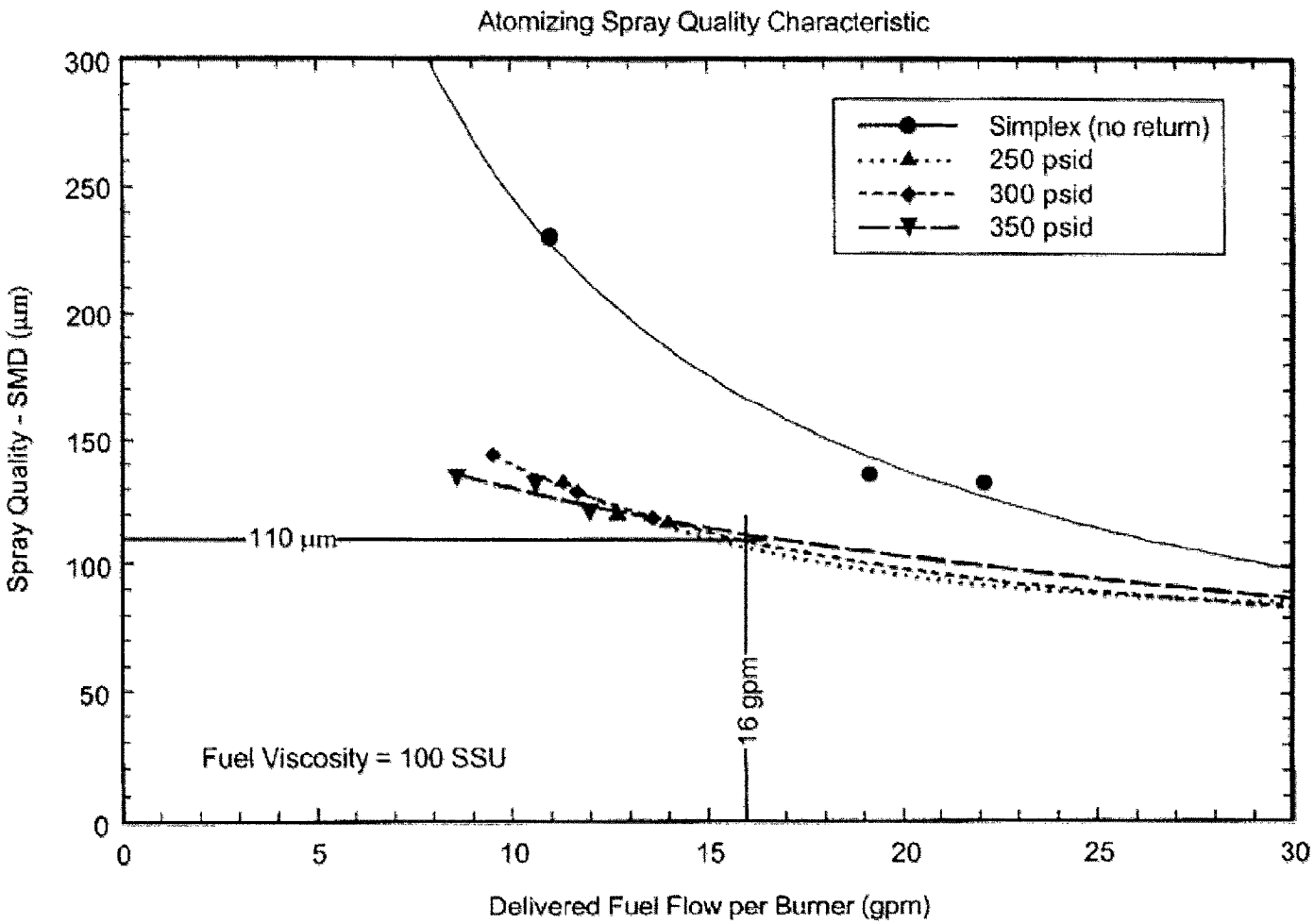
FIG. 6 is another graph illustrating performance of an atomizer spray plate according to an exemplary embodiment of the present invention.

FIGS. 5-6 illustrate performance of a prototype of an atomizer spray plate 100 according to an exemplary embodiment of the present invention. FIG. 5 shows a graph of delivered fuel flow in gallons per minute (gpm) as a function of fuel supply pressure in pounds per square inch gauge (psig) for the spray plate 100. Performance of the exemplary spray plate 100 is also shown under several pressure differential conditions including simplex (no return), 250 pounds per square inch differential (psid), 300 psid, and 350 psid. As shown in FIG. 5, at 300 psid a delivered fuel flow of 16 gpm correlates to approximately 940 psig of fuel supply pressure.

FIG. 6 shows a graph of spray quality or Sauter mean diameter ("SMD") in microns (μm) as a function of delivered fuel flow for an exemplary atomizer spray plate 100. As one of ordinary skill in the art would understand, mechanical atomization has always been limited to larger droplet sizes when compared to a generally preferred target of 100 SMD microns. 100 SMD μm has been achievable when by dual fluid atomization but very difficult when the lower cost mechanical atomization is used. However, as indicated in FIG. 6, the exemplary atomizer spray plate 100 provides a droplet size of 110 SMD μm at the delivered fuel flow of 16 gpm. Smaller droplet sizes are also provided at increased fuel flows. A conventional plate has a typical result of at least 141 SMD microns under similar conditions. This reduction in droplet size provided by the present invention results in better burnout of the fuel, lower excess oxygen in the boiler, lower opacity, lower sulfur trioxide ("$SO_3$") and lower $NO_x$.

Although the invention has been described with reference to a particular arrangement of parts, features and the like, these are not intended to exhaust all possible arrangements or features, and indeed many modifications and variations will be ascertainable to those of skill in the art.

What is claimed is:

1. An atomizer spray plate, comprising:

a body having an inlet surface and an exit surface;

a swirl chamber within said body and adjacent to the inlet surface;

an atomizer hole extending through the body from said swirl chamber to the exit surface; and a plurality of elongated protrusions upon the inlet surface extending radially from said swirl chamber;

wherein said plurality of elongated protrusions define a plurality of venturi inlets to said swirl chamber between adjacent protrusions;

wherein a fluid flows from the inlet surface through said plurality of venturi inlets into the swirl chamber;

wherein said plurality of venturi inlets are shaped such as to receive the fluid at a first velocity and provide the fluid to said swirl chamber at a second increased velocity in accordance with the Venturi effect; and wherein each of said plurality of venturi inlets has a first width and a second width downstream from the first width with respect to the direction of the fluid flow, the second width being greater than the first width.

2. The atomizer according to claim 1, wherein the spray plate is adapted to receive a liquid fuel via the inlet surface and discharge a fuel mist via the exit surface.

3. The atomizer according to claim 2, wherein the fuel mist has a mean droplet diameter less than 120 μm.

4. The atomizer spray plate according to claim 1, wherein said swirl chamber has a first diameter adjacent to the inlet surface and a second diameter adjacent to said atomizer hole, the first diameter being greater than the second diameter.

5. The atomizer spray plate according to claim 1, wherein said swirl chamber has a frustoconical shape.

6. The atomizer spray plate according to claim 1, wherein said swirl chamber has a hemispherical shape.

7. The atomizer spray plate according to claim 1, wherein each of the plurality of protrusions are situated at an angle with respect to a tangent to an inlet edge of said swirl chamber at the base of the particular protrusion, the angle being less than ninety degrees.

8. The atomizer spray plate according to claim 1, wherein said plurality of protrusions comprises at least nine protrusions equally spaced about said swirl chamber.

9. The atomizer spray plate according to claim 1, wherein the inlet surface includes a raised outer edge circumscribing said plurality of protrusions.

10. The atomizer spray plate according to claim 1, wherein the inlet surface is adapted to receive fuel oil at an outboard portion of the inlet surface and supply the fuel oil via the venturi inlets to said swirl chamber.

11. The atomizer spray plate according to claim 1, wherein said body is substantially cylindrical.

12. The atomizer spray plate according to claim 1, wherein the exit surface includes two or more discharge slots for directing a spray pattern of exiting fluid.

13. An atomizer spray plate, comprising:

a body having an inlet surface and an exit surface;

a swirl chamber within said body and adjacent to the inlet surface;

an atomizer hole extending through the body from said swirl chamber to the exit surface; and a plurality of venturi inlets upon the inlet surface extending radially from said swirl chamber;

wherein a fluid flows from the inlet surface through said plurality of venturi inlets into the swirl chamber;

wherein said plurality of venturi inlets are shaped such as to receive the fluid at a first velocity and provide the fluid to said swirl chamber at a second increased velocity in accordance with the Venturi effect; and wherein each of said plurality of venturi inlets has a first width and a second width downstream from the first width with respect to the direction of the fluid flow, the second width being greater than the first width.

14. The atomizer according to claim 13, wherein the spray plate is adapted to receive a liquid fuel via the inlet surface and discharge a fuel mist via the exit surface.

15. The atomizer according to claim 14, wherein the fuel mist has a mean droplet diameter less than 120 μm.

16. The atomizer spray plate according to claim 13, wherein said swirl chamber has a frustoconical shape.

17. The atomizer spray plate according to claim 13, wherein the exit surface includes two or more discharge slots for directing a spray pattern of exiting fluid.

18. The atomizer spray plate according to claim 13, wherein said swirl chamber has a first diameter adjacent to the inlet surface and a second diameter adjacent to said atomizer hole, the first diameter being greater than the second diameter.

19. An atomizer assembly for an oil fired burner, comprising:

a spray plate comprising a body having an inlet surface and an exit surface, a swirl chamber adjacent to the inlet surface, an atomizer hole extending through the body from said swirl chamber to the exit surface, and a plurality of elongated protrusions upon the inlet surface extending radially from said swirl chamber, wherein said plurality of elongated protrusions define a plurality of venturi inlets to said swirl chamber between adjacent protrusions, wherein a fluid flows from the inlet surface through said plurality of venturi inlets into the swirl chamber, and wherein said plurality of venturi inlets are shaped such as to receive the fluid at a first velocity and provide the fluid to said swirl chamber at a second increased velocity in accordance with the Venturi effect;

a back plate mountable adjacent to the inlet surface; and a housing comprising said spray plate and said back plate;

wherein the atomizer is adapted to receive liquid fuel and discharge a fuel mist via the exit surface wherein each of said plurality of venturi inlets has a first width and a second width downstream from the first width with respect to the direction of the fluid flow, the second width being greater than the first width.

20. The atomizer according to claim 19, wherein the exit surface includes two or more discharge slots for directing a spray pattern of exiting fluid.

* * * * *